US006318014B1

(12) United States Patent
Porter

(10) Patent No.: US 6,318,014 B1
(45) Date of Patent: Nov. 20, 2001

(54) HANDGUN ADAPTER

(76) Inventor: Richard R. Porter, 205 St. Mary's Pkwy., Fayetteville, NC (US) 28303

( * ) Notice: Subject to any disclaimer, the term of this patent is extended or adjusted under 35 U.S.C. 154(b) by 0 days.

(21) Appl. No.: 09/475,314

(22) Filed: Dec. 30, 1999

(51) Int. Cl.[7] ..... F41C 23/00
(52) U.S. Cl. ..... 42/72; 42/71.01; 42/71.02
(58) Field of Search ..... 42/72, 75.03, 71.01, 42/71.02

(56) References Cited

U.S. PATENT DOCUMENTS

| | | | | |
|---|---|---|---|---|
| 223,926 | * | 1/1880 | Kinney | 42/72 |
| 1,206,234 | * | 11/1916 | Lovell | 42/71.01 |
| 1,340,127 | * | 5/1920 | Welch | 42/72 |
| 1,367,996 | | 2/1921 | Sussman . | |
| 1,452,123 | * | 4/1923 | McCrudden | 42/75.03 |
| 2,056,975 | | 10/1936 | Michal, Jr. . | |
| 2,139,691 | * | 12/1938 | Michel, Jr. | 42/72 |
| 2,145,078 | * | 1/1939 | Ferrel | 42/72 |
| 2,439,137 | * | 4/1948 | Keller | 42/71.01 |
| 2,456,280 | * | 12/1948 | Humeston | 42/75.03 |
| 2,547,180 | * | 4/1951 | Taylor | 42/72 |
| 2,611,204 | * | 9/1952 | Robinson | 42/75.03 |
| 3,011,283 | * | 12/1961 | Lunn et al. | 42/71.01 |
| 3,323,246 | * | 6/1967 | Loffler | 42/75.03 |
| 3,685,194 | | 8/1972 | Coon | 42/72 |
| 3,798,818 | | 3/1974 | Casull | 42/72 |
| 3,857,323 | * | 12/1974 | Ruger et al. | 89/191 |
| 4,271,623 | | 6/1981 | Beretta | 42/72 |
| 4,276,807 | * | 7/1981 | Whitlock | 42/72 |
| 4,321,765 | | 3/1982 | Gillum | 42/72 |
| 4,735,007 | | 4/1988 | Gal | 42/72 |
| 4,890,405 | * | 1/1990 | Krouse | 42/75.03 |
| 4,989,358 | | 2/1991 | Aronson et al. | 42/72 |
| 5,092,070 | | 3/1992 | Perkins | 42/71.02 |
| 5,180,874 | | 1/1993 | Troncosco, Jr. | 42/72 |
| 5,417,002 | * | 5/1995 | Guerra | 42/72 |
| 5,479,736 | | 1/1996 | Forrester | 42/72 |
| 6,055,760 | * | 5/2000 | Cuson et al. | 42/74 |
| 6,070,354 | * | 6/2000 | Burigana et al. | 42/71.01 |

* cited by examiner

*Primary Examiner*—Michael J. Carone
*Assistant Examiner*—Denise J Buckley
(74) *Attorney, Agent, or Firm*—Coats & Bennett, P.L.L.C.

(57) ABSTRACT

An adapter for converting a handgun into a rifle or carbine. The adapter includes an elongated member having a stock and a pair of sidewalls forming a cavity. A pair of guide rails is positioned on an inner edge of the cavity, and a locking bar is mounted within the sidewalls and extends across the cavity. The locking bar is selectively positionable between a locked position and an unlocked position. A handgun mounts into the adapter by aligning channels on the outer edge of the handgun into the guide rails. The handgun is slid along the guide rails and into the locking mechanism for attachment.

12 Claims, 4 Drawing Sheets

HANDGUN ADAPTER

FIELD OF THE INVENTION

The present invention is directed to an adapter for mounting to a handgun and, more particularly, to an adapter having guide rails and a locking mechanism that mates with rails on an outer edge of the handgun to convert a handgun into a carbine or rifle.

BACKGROUND OF THE INVENTION

Handguns and rifles are two different types of firearms used in a variety of applications. Each type of firearm has advantages and disadvantages over the other which dictate under which circumstances each is best suited for use. By way of example, a handgun is smaller and more easily carried, therefore it is often issued to police officers and military personnel as standard equipment. Alternatively, a rifle is considered a more accurate weapon partly because of the supporting stock that is pressed against the user's shoulder for support when aiming and firing.

One disadvantage of using a handgun is the difficulty in accurately aiming the weapon. The handgun is usually aimed by holding it away from the body with the arm in a substantially extended position. Many users grip the handgun with both hands for further accuracy and control. The weight of the handgun makes it difficult to hold in the extended position for any period of time because the muscles in the user's hands and arms begin to tire. If the user is under heavy physical assertion, such as a police officer chasing a suspect, it is additionally difficult to hold the handgun steady and accurately aim.

When the handgun is fired, the force of the recoil is absorbed by the user's hands and arms which is uncomfortable for many users. The recoil may further decrease the accuracy of the handgun as many users will flinch while firing in expectation of the recoil thereby altering the accuracy.

Various conversion kits have been invented for mounting a stock to the handgun. However, these kits have various drawbacks. Several kits require that mounts be permanently affixed to the handgun for attaching the stock. These mounts require holes be drilled into the handle, or some other permanent fixture attached to the handgun. Many users do not want their handguns damaged as they may be collectable items that will lose value if they become defaced. Additionally, the mounts and holes are difficult to accurately place on the handgun and often require the work be performed by a knowledgeable technician or the use of specialized tools.

Another drawback of previous conversion kits is the length of time in assembling and disassembling the kit. These kits often involve numerous pieces that must be attached in a particular order. These types of kits are not applicable for use in the field such as by armed forces personnel or police officers which must quickly and easily convert the handgun. Additionally, it is difficult to carry around all the elements of the conversion kit without accidentally losing them.

SUMMARY OF THE INVENTION

The present invention allows for a handgun user to quickly and easily obtain the advantages of a rifle or carbine. The handgun can be mounted to the adapter in situations in which a rifle or carbine is more advantageous. Likewise, the handgun can be dismounted from the adapter when the situation dictates. The adapter includes an elongated cavity sized for receiving the handgun. A pair of guide rails are positioned on an inner edge of the cavity and extend outward for mating with channels located on a lower edge of the handgun. A locking mechanism positioned along the guide rails releasably locks the handgun into the adapter.

The locking mechanism may include a locking bar mounted across the cavity and selectively positionable between locked and unlocked positions. A biasing member may be positioned adjacent to the locking bar for urging it into the locked position. The adapter may include cutaway sections that allow for the user to better grasp the handgun when mounted, and also allow for the handgun to function properly. An accessory block or grip may also be positioned on the adapter.

The handgun used with the adapter preferably includes channels that are preferably positioned on a lower edge of the handgun, adjacent to the barrel. As these channels are already present, it is not necessary to damage the handgun such as by drilling holes or inserting screws into sections of the handgun. When mounting the handgun to the adapter, the handgun is positioned within the cavity and the adapter guide rails are inserted into the handgun channels. The handgun is slid along the guide rails until it seats into the locking mechanism. The locking mechanism holds the handgun firmly in place when in the locked position, even when the handgun is fired.

DETAILED DESCRIPTION OF THE INVENTION

Figure 1:
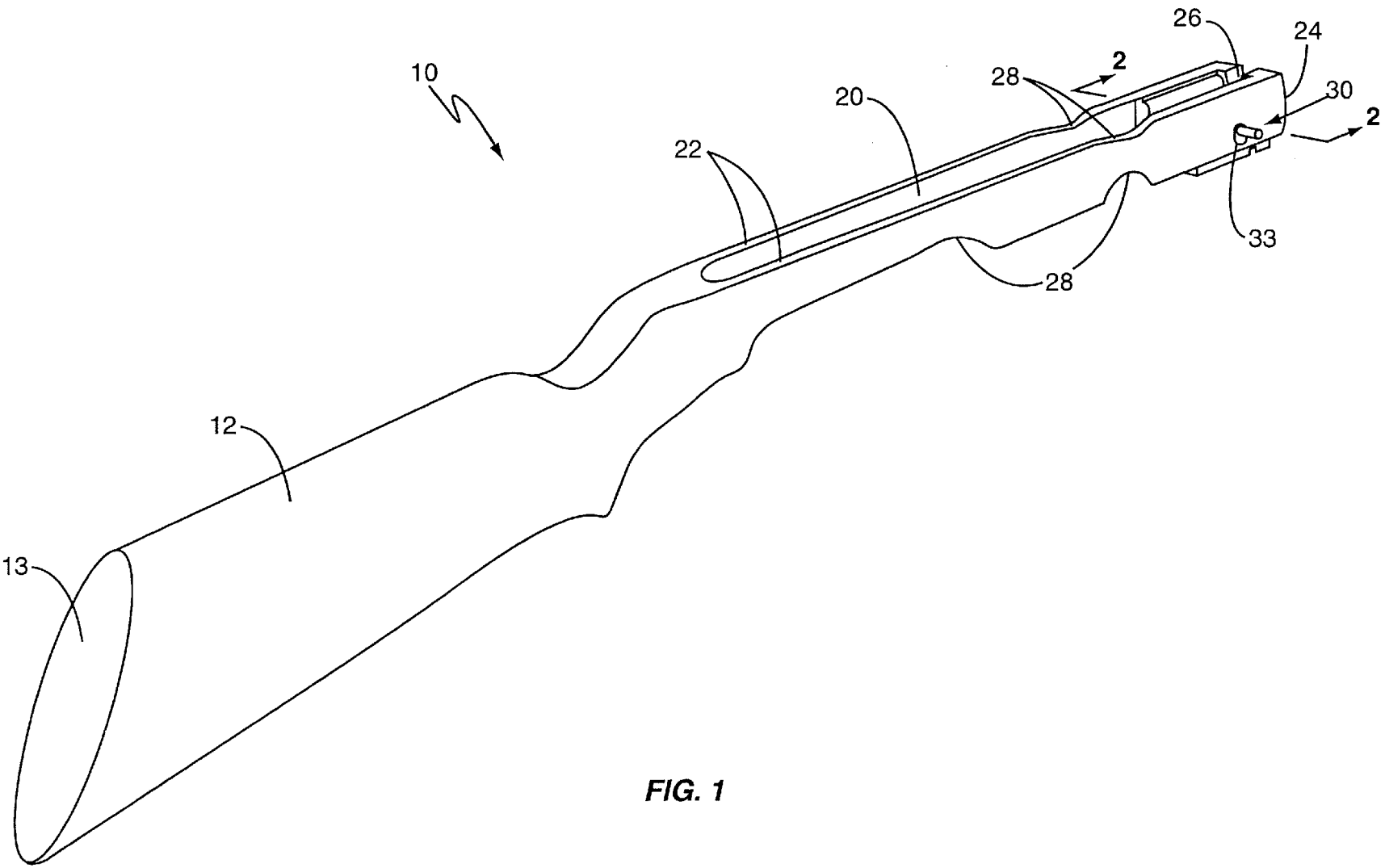
FIG. 1 is a perspective view of the handgun adapter constructed according to the present invention.

Referring now to the drawings, an adapter for mounting to a handgun is illustrated in FIG. 1 and generally indicated by the numeral 10. Like-reference characters designate like or corresponding parts throughout the several views. The terms "back" and "forward" are used throughout the invention as relative terms to describe positioning along the length of the adapter 10. The "back" is the adapter end mounted against a user's shoulder when firing the firearm, and the "front" is the end away from the user. The term "firearm" is used to describe a variety of weapons including handguns, rifles, carbines, etc. The adapter 10 includes a stock 12, sidewalls 22 forming a cavity 20, and a locking mechanism 30. The adapter 10 allows a user to quickly and easily mount a handgun 100 to obtain the advantages of a rifle or carbine.

Figure 4A:
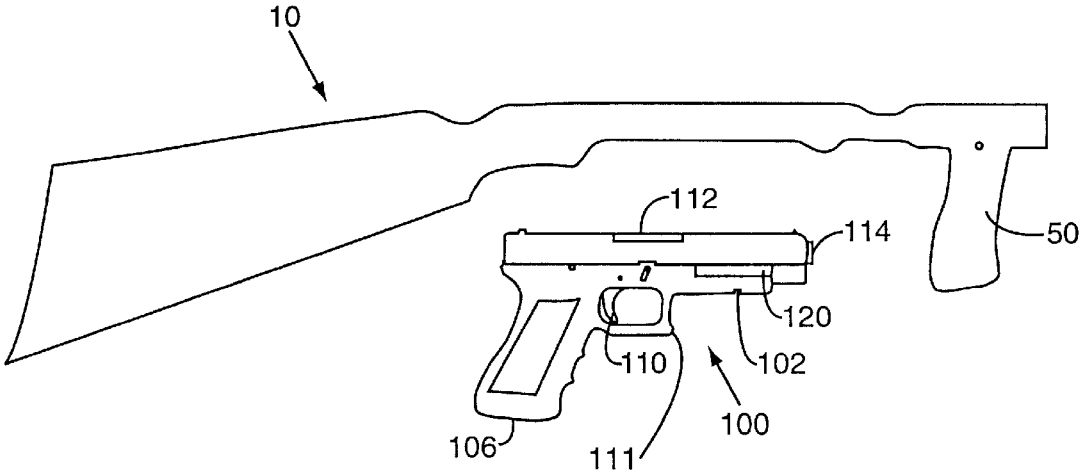
FIG. 4A is a side view illustrating a first step in inserting a handgun into the adapter.
Figure 5:
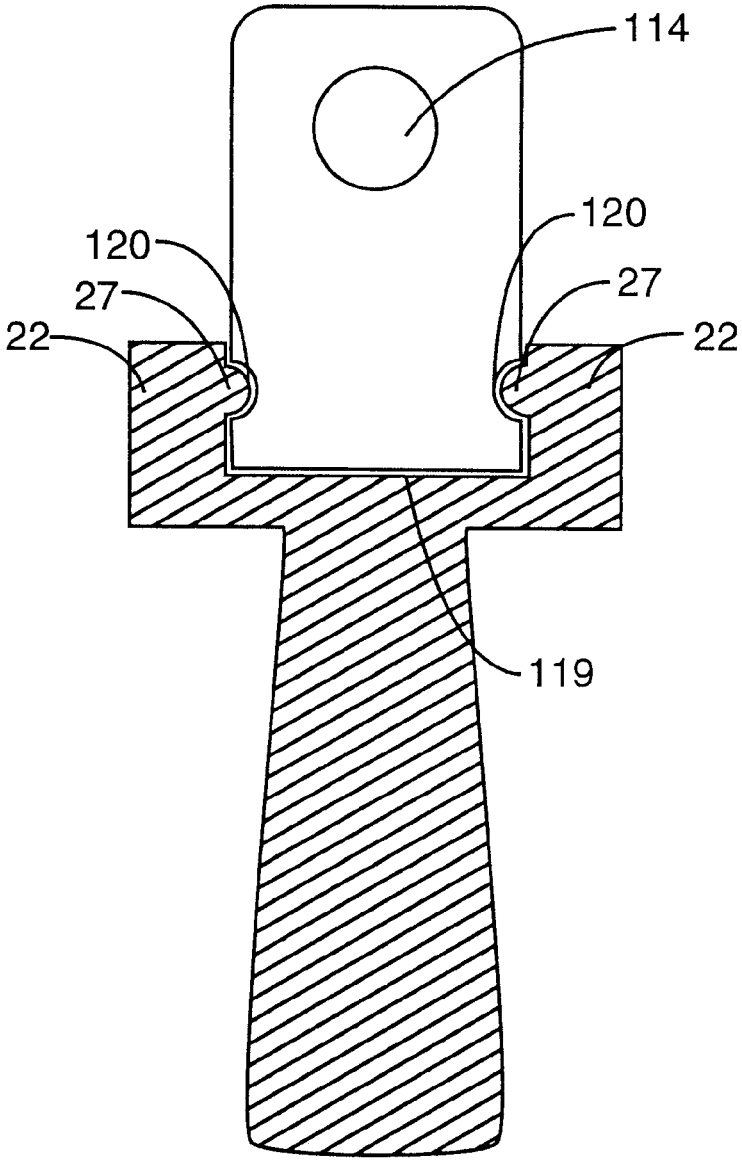
FIG. 5 is a side view cut along line 5—5 of FIG. 4C illustrating the handgun inserted within the guide rails of the adapter.

The handgun 100 includes channels 120 extending along a length of the gun, preferably adjacent to the barrel 114 as illustrated in FIG. 5. As illustrated in FIG. 4A, a slot 102 is positioned along a lower edge of the handgun for receiving the adapter locking mechanism 30. The adapter 10 is mounted to the handgun 100 via the channels 120 and slot 102 and does not require the user to make any alterations to the handgun.

The adapter stock 12 includes a back edge 13 that is braced against the user's arm or shoulder during shooting. The length of the stock extending between the back edge 13 and the cavity 20 may vary depending on specific applications, as well as the dimensions and specific shape of the stock 12. In one embodiment, the stock 12 includes apertures (not shown) for reducing the weight of the stock to better balance the weight of the combination adapter 10 and handgun 100 for easier aiming and handling by the user. The stock 12 may further be removable from the adapter 10, or may be collapsible.

The sidewalls 22 extend between the stock 12 and a front wall 24 as illustrated in FIG. 1. A cavity 20 is formed between the sidewalls 22 and is centered within the width of the adapter 10. The sidewalls 22 may further include a variety of cutaway sections 28. Functional components of the handgun 100 such as the grip 106, trigger 110 and trigger guard 111, and ejection port 112 are aligned with each of the cutaway sections 28 when mounted within the adapter 10 thereby allowing for the handgun to properly function without being inhibited by the adapter. Access to the grip 106 and trigger 110 also allows the user to have a more comfortable and effective holding position.

Figure 3:
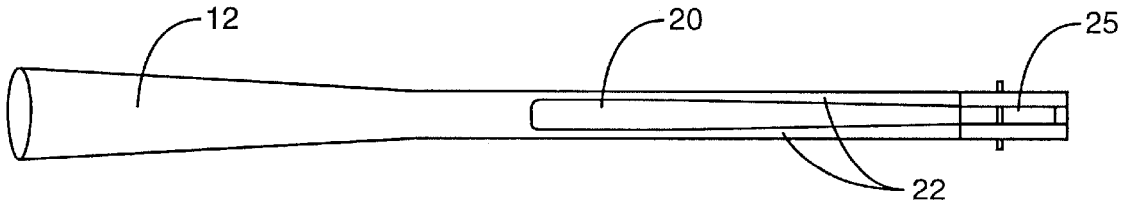
FIG. 3 is a top view of the adapter constructed according to the present invention.

The cavity 20 may have a variety of dimensions. As illustrated in FIG. 1, the cavity width is substantially the same throughout the length. Alternatively as illustrated in FIG. 3, the cavity 20 has a larger width towards the back edge and narrows towards the front end. This cavity dimensioning allows for easy insertion of the handgun 100 at the cavity back end and then more intricate alignment and mounting towards the front of the cavity.

Guide rails 27 are positioned in coplanar relation to mate with each of the handgun channels 120 as best illustrated in FIG. 5. In one preferred embodiment, the guide rails 27 are semicircular extensions located along each inner edge of the sidewalls 22. However various other shapes are also contemplated by the present invention.

The guide rails 27 are positioned at the forward end of the adapter 10, and may extend backward along the cavity a variety of lengths beyond the locking mechanism 30. In the embodiment illustrated in FIG. 1, guide rails 27 extend from the front wall 24 backward to a point immediately beyond the locking mechanism 30.

Figure 2:
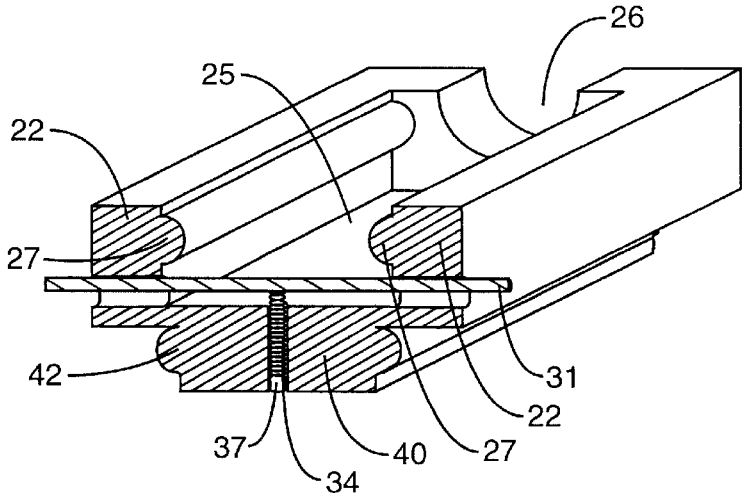
FIG. 2 is a partial perspective view cut along line 2—2 of FIG. 1 illustrating the guide rails and locking mechanism.

In one embodiment as illustrated in FIGS. 2, 3, and 5, a support floor 25 is positioned at a front end of the cavity 20. The support floor 25 guides and supports the handgun 100 during insertion and mounting to the guide rails 27. Preferably, a bottom edge of the handgun 119 rests against the support floor 25. Alternatively, the handgun 100 is held in place via the guide rails 27 and the biasing action of the locking mechanism 30 with no support floor.

A locking mechanism 30 allows for securing the handgun 100 to the adapter 10. Preferably, the locking mechanism 30 includes a locking bar 31 with a biasing member 34. The locking bar 31 extends across the width of the adapter 10 and is mounted within elongated apertures 33 within the sidewalls 22. The locking bar 31 extends beyond the sidewalls 22 forming a gripping surface for the user to push downward against the biasing member 34 to lock and unlock the handgun 100 from the adapter 10. Various other types of locking mechanisms are also available that do not extend into the sidewalls and are also contemplated by the present invention.

The biasing member 34 biases the locking bar 31 into the locked position. Biasing member 34 may have a variety of applications including a coil spring, or a leaf spring. In one embodiment illustrated in FIG. 2, the biasing member 34 is positioned within an aperture 37 within the floor support 25.

An accessory mount 40 may be positioned on a lower edge of the adapter for receiving accessories such as a laser attachment or flashlight. The accessory mount 40 preferably includes a pair of extensions 42 that correspond to the mounting guides rails 27. The accessories include channels similar to the handgun channels 120 that mate with the extensions 42 for mounting. Preferably, a slot extends across the width of the accessory mount for receiving a locking member on the accessory in similar fashion to the adapter locking mechanism 30.

Figure 4B:
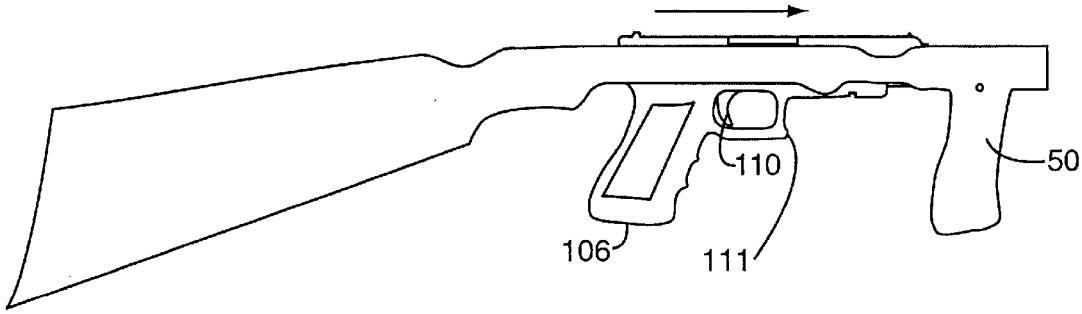
FIG. 4B is a side view illustrating a second step in inserting a handgun into the adapter.
Figure 4C:
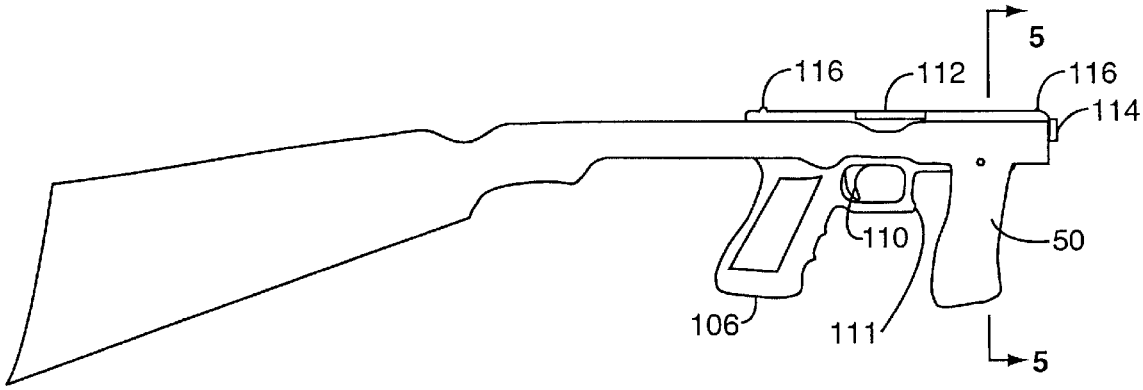
FIG. 4C is a side view illustrating the handgun mounted within the adapter.

In an alternative embodiment as illustrated in FIGS. 4A–4C, a grip 50 extends from the adapter 10 allowing the user a steadying handhold. The embodiment as illustrated includes the grip 50 extending from a lower edge of the adapter 10, however, the grip 50 may be positioned to extend outward at a variety of angles.

FIGS. 4A–4C illustrate the mounting procedure for attaching the handgun 100 to the adapter 10. The handgun 100 includes channels 120 positioned along a lower, front edge and a slot 102 positioned on a bottom, front edge as illustrated in FIG. 4A. The slot 102 preferably extends across the width of the handgun. The handgun 100 further includes a handle 106, and a trigger 110 and trigger guard 111. A barrel 114 is positioned along an upper edge and ejection port 112 allows for discarding spent shell casings. One type of handgun having a channel system suitable for mounting to the adapter is manufactured by Glock, Inc.

The user begins by inserting the handgun 100 into the cavity 20. The cavity 20 is preferably sized such that the handgun 100 can be inserted from the bottom or top of the adapter 10. Once inserted, the handgun 100 is moved towards the front section of the adapter 10. The adapter guide rails 27 are aligned with the handgun channels 120. As the handgun 100 continues to move toward the adapter front end, either the movement of the guides 104 along the guide rails 27 pushes the locking bar 31 in a downward position, or the user forces the locking bar downward by grasping the protruding locking bar 31.

At the mounting point illustrated in FIG. 4C, handgun slot 102 aligns with the locking bar 31 allowing the biasing member 34 to force the locking bar upward into the slot 102. At this mounting position, the barrel 114 extends outward from the front wall 24, and the top edge of the firearm 100 is positioned above the sidewalls 22 allowing for the sights 116 to be unobscured. The cutaway sections 28 align with the ejection port 112, trigger 110 and trigger guard 111, and handle 106. The handgun 100 may also be mounted at different locations along the length of the adapter depending upon the required application.

The user may brace the stock 12 against their shoulder, and grasp the firearm handle 106 and adapter grip 50. The cutaway sections 28 align with functional components of the handgun such as adjacent to the ejection port 112 to allow shell casings to be discharged. Additionally, the handle 106 is preferably positioned adjacent to a cutaway section 28 for the user to grasp both the adapter and handle with one hand to have better feel and control during firing. The locking mechanism 30 maintains the handgun securely mounted within the adapter 10 such that there is no need for adjustment of the handgun after each shot is fired. The handgun 100 is removed from the adapter 10 by forcing the locking bar 31 away from engagement with the slot 102 and sliding the firearm towards the back edge of the adapter 10. The adapter 10 may then be stored separately from the handgun 100 as is convenient for the user.

Certain modifications and improvements will occur to those skilled in the art upon a reading of the foregoing description. By way of example, the adapter 10 may have a variety of shapes and sizes to accommodate various sizes and calibers of handguns. It should be understood that all such modifications and improvements have been deleted herein for the sake of conciseness and readability but are properly within the scope of the following claims.

What is claimed is:

1. An adapter for mounting a handgun comprising:

an elongated cavity sized for receiving a handgun;

guide rails positioned on an inner edge of said cavity with a first guide rail positioned on a first inner edge and a second guide rail positioned on a second inner edge, each of said guide rails positioned lengthwise along at least a portion of said elongated cavity and extending outward into said elongated cavity to mate with the handgun; and a lock positioned along said guide rails and adapted to releasably engage the handgun so as to mate the adapter with the handgun, said lock having a locking bar vertically movable between a first locked position in which said locking bar is positioned within said cavity, and a second unlocked position in which said locking bar is positioned out of said cavity, said locking bar further being permanently mounted within walls forming said elongated cavity.

2. The device of claim 1, wherein said cavity is in a forward end of the adapter.

3. The device of claim 2, wherein said guide rails are positioned on a forward end of said cavity.

4. The device of claim 3, wherein said guide rails extend into said cavity from a pair of side walls.

5. The device of claim 1, wherein said locking mechanism includes a locking bar and biasing member.

6. An adapter for receiving a handgun comprising:

an elongated member having a stock and a pair of sidewalls forming a cavity;

a pair of guide rails positioned on respective inner edges of said cavity; and a locking bar mounted at least partially within said sidewalls, said locking bar selectively positionable between a locked position and an unlocked position, in said locked position said locking bar extending across said cavity and through said sidewalls at a position above a support floor of said between cavity and said pair of guide rails, and in said unlocked position being positioned at a point below said support floor.

7. The adapter of claim 6, further including a biasing member for biasing said locking bar toward said locked position.

8. The adapter of claim 7, wherein said locking bar is mounted within elongated openings in said sidewalls.

9. The adapter of claim 6, wherein said cavity is wider at a back end than at a front end.

10. The adapter of claim 6, wherein said elongated member includes at least one cutaway section adjacent to said cavity.

11. The adapter of claim 6, further including a grip extending outward from said elongated member.

12. The adapter of claim 6, further including an accessory block positioned on a lower edge of said elongated member.

* * * * *